United States Patent [19]

Bartholomew

[11] 4,039,169

[45] Aug. 2, 1977

[54] CONTINUOUS SAND MULLER

[75] Inventor: Gordon Bartholomew, Muscatine, Iowa

[73] Assignee: Carver Foundry Products, Progress Park, Iowa

[21] Appl. No.: 654,338

[22] Filed: Feb. 2, 1976

[51] Int. Cl.[2] ..... B01F 7/04; B01F 7/08

[52] U.S. Cl. ..... 259/10; 259/161; 259/165; 259/178 R

[58] Field of Search ..... 259/5, 6, 7, 9, 10, 259/21, 22, 25, 26, 65, 68, 69, 146, 161, 165, 168, 178 R, 179, 45, 46, 169

[56] References Cited

U.S. PATENT DOCUMENTS

| | | | |
|---|---|---|---|
| 1,732,281 | 10/1929 | Robinson | 259/169 X |
| 1,753,716 | 4/1930 | Owen | 259/168 X |
| 3,006,615 | 10/1961 | Mason | 259/168 X |
| 3,067,987 | 12/1962 | Ballou et al. | 259/7 |
| 3,191,912 | 6/1965 | Frye | 259/7 |
| 3,268,214 | 8/1966 | Higgs | 259/10 |
| 3,346,240 | 10/1967 | Lavelle et al. | 259/26 |
| 3,430,929 | 3/1969 | Kawecki | 259/146 |
| 3,885,774 | 5/1975 | Harris et al. | 259/178 R X |
| 3,934,858 | 1/1976 | Parsonage et al. | 259/178 R X |

*Primary Examiner*—Philip R. Coe

*Attorney, Agent, or Firm*—Price, Heneveld, Huizenga & Cooper

[57] ABSTRACT

A continuous sand muller for efficiently mixing foundry sand and resin/catalyst binder additives includes a pair of preblending tubes and a primary mixing tube. Sand and the resin binder are introduced into one of the premixing tubes where the resin binder is thoroughly mixed with the sand. A catalyst is added to the sand in the second premixing tube where it is also thoroughly mixed with the sand. Both of the premixing tubes simultaneously deposit the premixtures into the primary mixing tube. A high intensity auger combines the two premixes and delivers the final sand mix to an outlet. A sand supply system and a binder supply system are provided for instantaneous supply of sand and binder additives to the premix tubes.

8 Claims, 14 Drawing Figures

CONTINUOUS SAND MULLER

BACKGROUND OF THE INVENTION

This invention relates to foundry equipment and, more particularly, to continuous sand mullers for mold or core production.

In the production of sand molds or cores, it has been general foundry practice to bond the sand with clay, bentonite, sodium silicate or other such binders. Fairly recently, a wide variety of relatively quick setting resin binders have been made available to the foundry industry. These binders have relatively short working times and strip times and do not require baking for proper set. Conventional mulling equipment, due to their relatively low intensity mixing action, have not characteristics capable of making full use of the quick setting charcteristics of the various resin binder systems. In fact, the average residence time needed to insure thorough mixing of the sand, catalyst and resin has been on the order of four to eight minutes. Further, the sand mix has a tendency to precure in conventional mullers prior to deposition in the mold flask or core box. This can result in a lumpy or streaked sand mixture which does not set to maximum obtainable physical properties.

Continuous sand mullers have also recently become available to the foundry industry. These mullers generally incorporate a single, high intensity auger disposed within a trough for thoroughly mixing the sand and binder additives. With the majority of binder systems, it has been general practice to add either the resin or the catalyst to a metered stream of sand at the entry point to the continuous muller. The remaining additive is then introduced into the sand additive mixture downstream from the entry point. The sand mixture residence time within these continuous mullers has generally been on the order of twenty-five seconds. Due to the high intensity mixing action employed in these continuous mullers, substantial heat is imparted to the mixture which may result in some precuring prior to deposition in the core box or mold flask. Further, since the binder additives and the sand are all contained in a single auger or muller, should production be stopped for some reason, a quantity of sand mixture must be dumped. The additives and sand cannot be left in the muller for any length of time without setting. In order to clean such mullers, a quantity of raw sand must be passed through them. This procedure is both time consuming and wasteful of foundry sand.

It has also been proposed to premix a resin with a quantity of sand in a conventional type mulling trough and a quantity of catalyst additive and sand in another trough. Quantities of each of the premixes are then deposited in a batch-type mixer. While alleviating some of the problems experienced with mixing of resin/-catalyst binders totally within a conventional muller, problems have still been experienced. For example, such machines employ a batch-type mixer and, therefore, do not have instantaneous on/off sand mix capability. Therefore, should production problems such as unavailability of core boxes or mold flasks be encountered, substantial quantities of the sand mix must be dumped and therefore wasted. Also, these machines experience material buildup problems, requiring the use of raw sand for cleaning or purging purposes after each cycle.

With the various resin binder systems available, such as the no-bake furan, phenol formaldehyde, polymer isocyanate, or oil-urethane binder systems, the strip times may be decreased to the order of 25 or 30 seconds by increasing the amount of catalyst employed in the mix. Present mullers and mixing techniques have not been capable of accommodating such reduced strip times. Production has been limited, not by the binder systems, but by the availability of machines having adequate mixing ability.

A need, therefore, exists for a continuous-type sand muller having the capability of effectively and efficiently mixing foundry sand and a resin binder system with extremely low active mixture retention times. Such a system should be essentially self-cleaning, provide instant on/off control of sand and additive flow with no sand loss or time loss and with no reactive material remaining within the muller upon shutdown.

SUMMARY OF THE INVENTION

In accordance with the present invention a continuous, three tube muller is provided for efficiently mixing sand and binder additives. Essentially, the muller includes a pair of preblending or premix assemblies, each having a high intensity mixing auger. Sand and a binder additive are preblended in each of the assemblies. The output mixtures from the premix assemblies are deposited into a primary mixing assembly having a primary, high intensity mixing auger. The premixes are combined in the primary assembly. Provision is made for delivering a metered quantity of the binder additives to the preblending assemblies for mixing with a metered quantity of sand.

DETAILED DESCRIPTION OF THE PREFERRED EMBODIMENT

Figure 1:
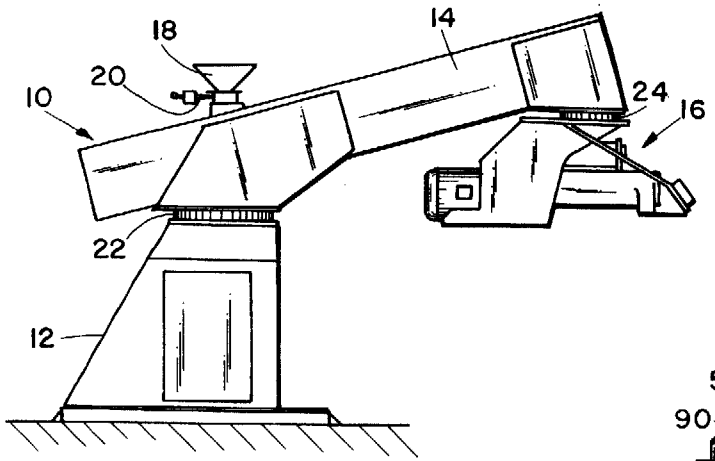
FIG. 1 is a side elevational view of a continuous muller in accordance with the present invention.

With reference to the drawings, FIG. 1 illustrates a continuous sand muller in accordance with the present invention generally designated 10. As shown therein, the continuous muller includes a support pedestal and housing assembly 12, a conveyor assembly 14, and a mixing head assembly 16. The conveyor assembly 14 houses a conventional, endless belt-type conveyor. A sand inlet hopper 18 is provided for directing sand for a suitable source to the inlet of the conveyor. A sand supply metering valve 20 is located at the throat of the inlet hopper 18. The valve 20 may be of a conventional air operated, ball valve-type. This valve is adjusted to meter an amount of sand to the main supply conveyor consonant with the capacity of the mixing head 16. As shown, the conveyor assembly 14 is mounted for at least limited rotational movement about the base 12 by a turntable-type assembly 22. Also, the mixing head assembly 16 is likewise mounted for limited rotational movement relative to the end of the conveyor assembly through a turntable or gear-type arrangement 24. As a result, the mixing head may be positioned over the boxes or flasks in the production area.

Figure 3:
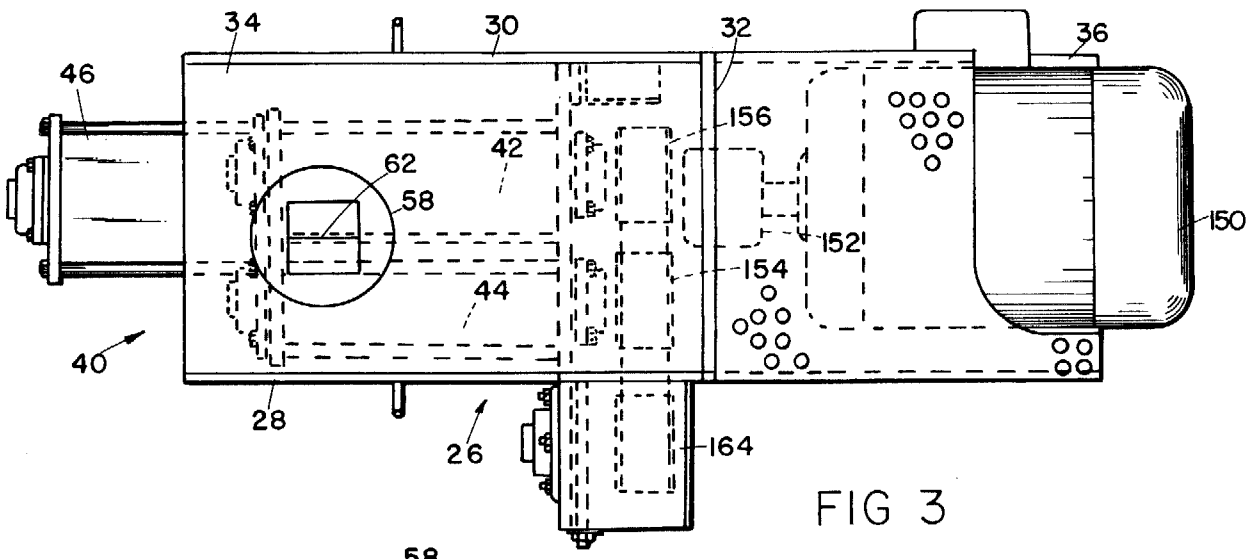
FIG. 3 is a plan view of the mixing head of FIG. 2.
Figure 2:
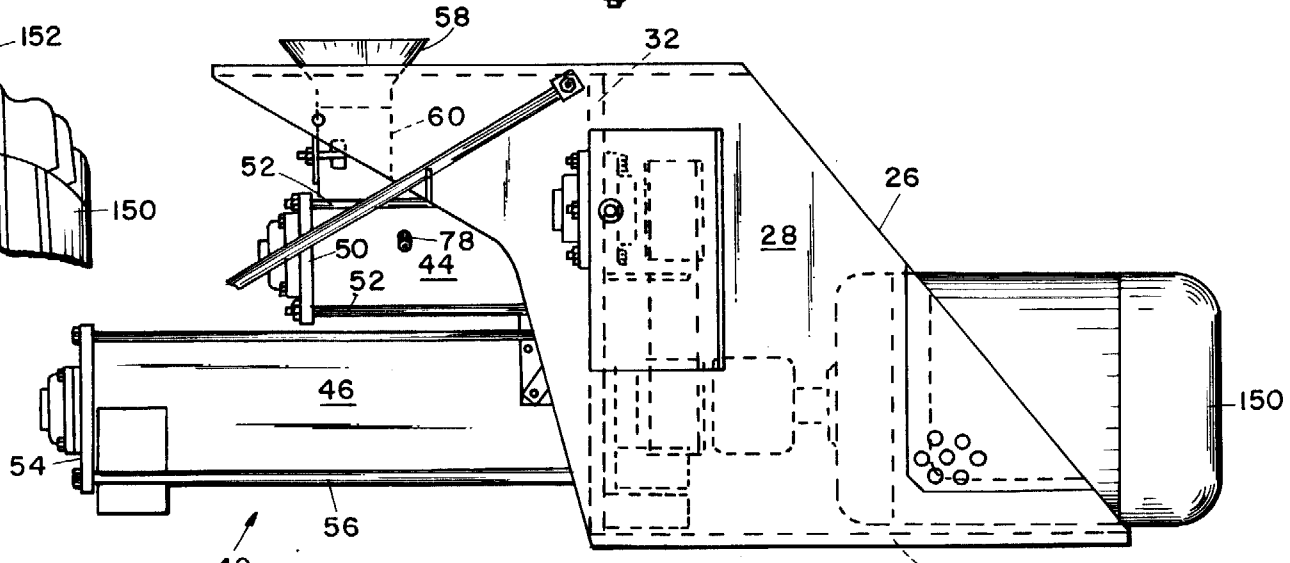
FIG. 2 is a side elevational view of the mixing head incorporated with the present invention.
Figure 4:
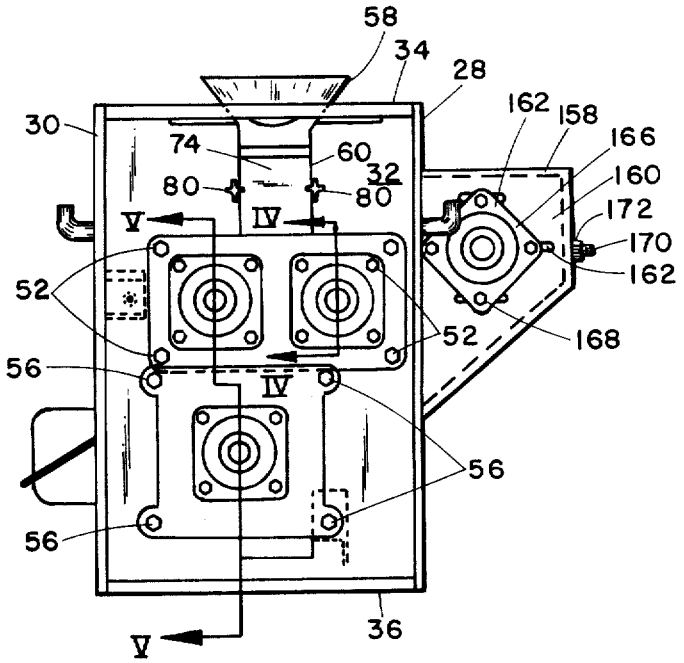
FIG. 4 is a front elevational view of the mixing head of FIGS. 2 and 3.

With reference to FIGS. 2, 3 and 4, the mixing head assembly 16 includes a mounting weldment or frame 26 securable to the conveyor assembly. The frame includes a pair of spaced side plates 28, 30, an intermediate, transversely extending, tube mounting plate 32, a top plate 34 and a lower drive motor mounting plate 36. The various members of the frame or assembly are suitably interconnected as by welding.

The frame 26 supports a three tube mixing subassembly 40. The mixing subassembly 40 includes two upper premixing tubes 42, 44 and a lower primary mixing tube 46. Premixing tubes 42, 44 are secured to the transverse member 32 in a side-by-side relationship by a tube end plate 50 and a plurality of tie rods 52. As is apparent from the drawings, the tubes 42, 44 are sandwiched between the end plate 50 and the mounting member 32. The tie rods extend through apertures formed at the corners of the plate 50 and through the member 32 where they are secured by suitable fasteners.

In a similar manner, the primary mixing tube 46 is secured to the support member 32 by a forward mounting plate 54 and a plurality of tie rods 56.

A mixing head, sand inlet funnel or hopper 58 is positioned in an aperture formed in the upper frame member 34. The hopper 58 is shaped so as to mate with a transition or sand feed tube 60. As best seen in FIG. 3, a vertically extending plate 62 is positioned within the transition tube 60 so as to split the incoming sand flow equally into the premix tubes 42, 44. Sand is supplied to the hopper 58 by the conveyor assembly 14.

Figure 7:
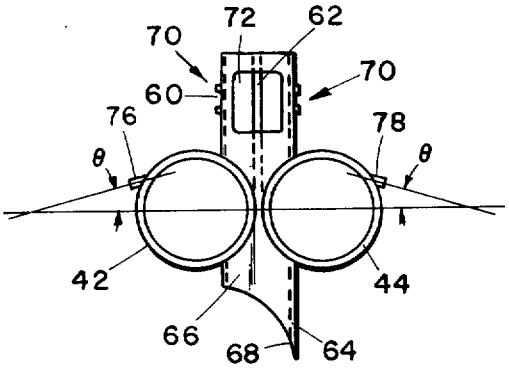
FIG. 7 is a front elevational view of the upper mixing tube assembly of the present invention.
Figure 8:
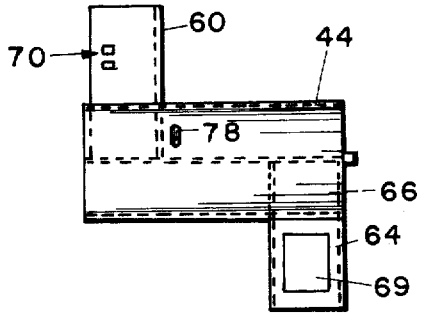
FIG. 8 is a side elevational view of the assembly of FIG. 7.

As best seen in FIGS. 7 and 8, the transition tube 60 is shaped at its lower end so as to mate with inlet apertures formed at the forward peripheral surfaces of the tubes 42, 44. A common premix tube outlet member 64 has an inlet end 66 shaped so as to mate with the outlet apertures formed at the rear ends of the tubes 42, 44. The outlet tube 64 is shaped at its lower ends 68 so as to mate with the cylindrical peripheral surface of the primary mixing tube 46 at an inlet aperture. An inspection hatch 69 may be included in the outlet member 64.

As best seen in FIGS. 2, 7 and 8, premixing tubes 42, 44 also include binder additive inlet coupling 76, 78 respectively. These couplings which are illustrated as short, tubular pipe nipples are secured at apertures in the outer peripheral surfaces of the premixing tubes located adjacent to but downstream from the sand inlets of the respective tubes. Also, as seen in FIG. 7, the couplings intersect the cylindrical premixing tubes at an angle $\theta$ measured frm the central horizontal plane of each tube. The couplings are angled so that the binder additives will enter the tubes in a generally tangential manner in the upper left hand quadrant of tube 42 and the upper right hand quadrant of tube 44. This tangential entry of the additives enhances the mixing of the sand and additives and reduces the possibility of material buildup in the area of the inlet to the tubes. An angle $\theta$ of 15° has been found to provide adequate mixing with practically no material buildup problems. The binder additive system connected to couplings 76, 78 will be fully described below in connection with FIG. 13.

Figure 6:
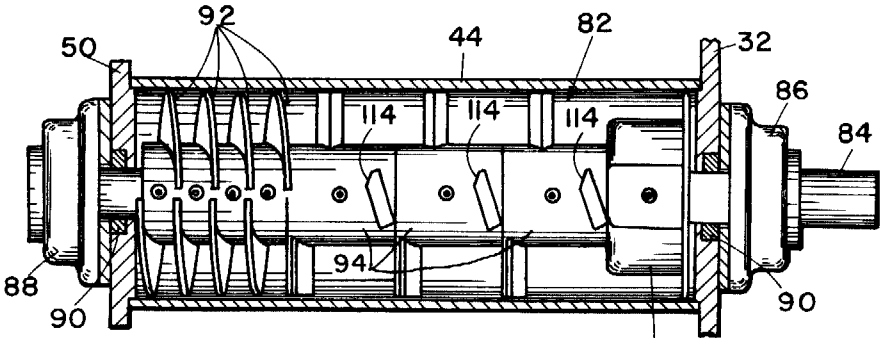
FIG. 6 is a cross-sectional view taken along line VI—VI of FIG. 4.
Figure 5:
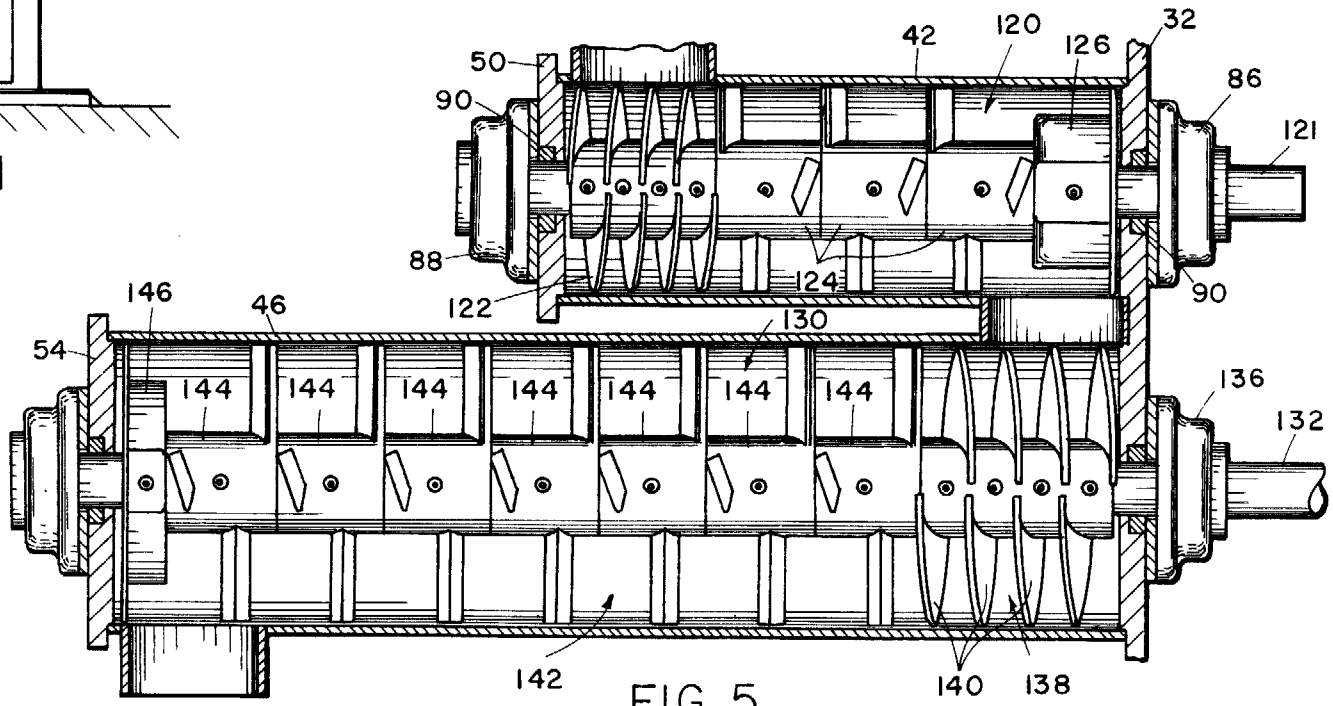
FIG. 5 is a cross-sectional view taken along line V—V of FIG. 4.

As best seen in FIGS. 5 and 6, each mixing tube 42, 44 and 46 defines a blending chamber within which are disposed high intensity mixing augers. The upper right-hand mixing tube 44 has disposed within its preblending chamber a high intensity premixing auger assembly 82. The auger assembly 82 includes a keyed, high speed shaft 84. The high speed shaft is supported at its rear or drive input end by a bearing assembly 86 secured to support member 32. The shaft 84 is supported at its front end by a bearing assembly 88 secured to the tube mounting plate 50. Suitable seals such as felt rings 90 are disposed around the high speed shaft 84 at the apertures formed in the tube mounting plate 50 and a support member 32.

The auger assembly 82 is divided into three sections. At the forward or inlet portion of the auger are dispoed a plurality of flightings 92. These flightings 92 define a spiral conveyor section. Intermediate the ends of the shaft and adjacent the spiral portion of the auger are disposed a plurality of paddle assemblies 94 defining a paddle mixing section. Finally, a slinger or discharge asssistant 96 secured to the shaft 84 adjacent the outlet of the premix tube 44 defines an output section. Since separate members are secured to the shaft to form each section, in the event of damage, repair is greatly facilitated.

Figure 9:
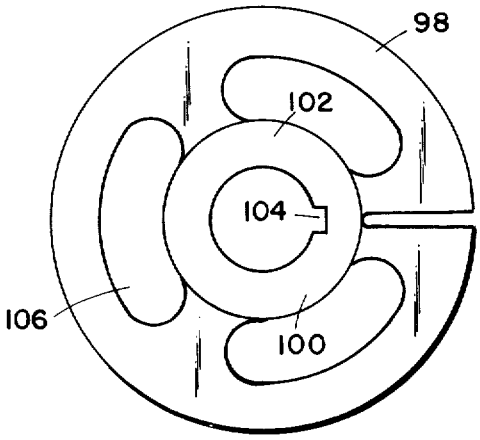
FIG. 9 is a front elevational view of the typical flighting employed in the present invention.

With reference to FIG. 9, each flighting 92 of the auger assembly is formed with a spiral, thread-like portion 98. The thread-like portion 98 is formed integral with or secured to a central hub member 100. The hub member 100 includes a through bore 102 slotted at 104 so as to be received by the keyed, high-speed shaft 84. The thread portion 98 of the flighting includes at 120° intervals a cutout portion 106. The flightings 92 having the cutout portions 106 at their bases, positively intake, convey and mix the foundry sand and binder additive. The cutout portions 106 eliminate or assist in preventing the buildup of material on the spirals during muller operation.

The paddle assemblies 94 each include a plurality of angled blades 110 secured to or formed integral with a central key slotted hub 112. Each blade 110 is beveled along its leading edge 114. The multiple paddle assemblies efficiently and thoroughly mix the foundry sand and additive deposited in the premixing tube 44.

The slinger 96 includes a central slotted hub 114, an end flange plate 116 and a plurality of equally spaced blades 118. The slinger 96 positively propels the thoroughly mixed or preblended sand and binder additive mixture into the primary mixing tube 46.

The left-hand preblending tube 42 has rotatably supported therein an auger assembly 120. The auger assembly 120 is basically the same as the assembly 82. The assembly 120 includes a keyed, high-speed shaft 121, flightings 122, paddle assemblies 124 and a discharge assistant or slinger 126. The only difference between the auger assemblies 120 and 82 is that assembly 82 is shown as a right helix and assembly 120 is shown as a left helix. The reason for this difference will become apparent from the manner in which the high-speed shafts are rotated. The helical direction of the augers must be such that the sand and additive mix will be conveyed from the tube inlet to the tube outlet or from the left to the right when viewed in FIGS. 5 and 6.

The primary mixing tube 46 includes a primary, high intensity auger assembly 130. The auger assembly 130 includes a keyed, high-speed shaft 132 rotatably supported within the primary tube 46 by bearing assemblies 134, 136. Non-rotatably supported to the primary auger, high-speed shaft 132 is a spiral conveyor section 138, including a plurality of flightings 140, a paddle section 142 including paddle assemblies 144 and an output slinger 146. The slinger 146 impacts or rams the sand mixture into the foundry core boxes or mold flasks in a conventional manner. As shown in FIG. 5, the primary high intensity mixing auger assembly 130 has a right-hand helix and functions to effectively combine the reactive preblended sand/resin and sand/catalyst mixtures received from the premixing tubes 42, 44. The flightings 140 of the primary mixing tube are of the same general shape as the flightings employed with the premix tube illustrated in FIG. 9 and include the cutouts for self-cleaning action.

The premixing tubes have been shown as including four flightings in their spiral conveyor intake sections and three paddle assemblies in their main premix portions. As is readily apparent to one of ordinary skill in the art, the required number, section length and helix pitch would be varied as a function of the speed of rotation of the shaft and the quantities of sand and binder additive mix handled; the primary requirement being that there be a sufficient action within the premix tubes so that the resultant sand/binder additive mixture is directed to the primary blending tube as a lump and streak-free thoroughly mixed material. In the same manner, the number of paddle sections, the length of the spiral conveyor, as well as the pitch of the spiral portion may be varied in the primary mixing tube.

Figure 12:
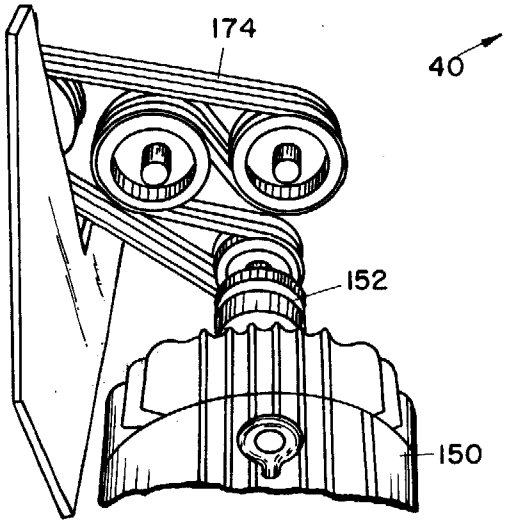
FIG. 12 is a fragmentary, perspective, rear elevational view of the mixing head.

As best seen in FIGS. 2, 3 and 12, all three mixing augers are rotated by a common drive motor 150 secured to support plate 36. The drive motor 150, which is preferably an AC type electric motor, is directly coupled to primary high-speed shaft 132 through a coupling 152. Non-rotatably supported on the shaft 132 is a sheave or pulley arrangement 154. Non-rotatably secured to the high-speed shafts 121, 84 of the premix tubes 42, 44 are sheave or pulley assemblies 155, 156 respectively. An idler pulleyor take-up sheave arrangement 158 is supported on the mounting plate 28.

As best seen in FIGS. 2, 3 and 4, the take-up assembly 158 includes an outwardly extending housing 160 having a plurality of elongated slots 162 formed therein. The take-up sheave 164 is rotatably secured to a mounting plate 166. The mounting plate is adjustably secured to the plate 160 by suitable fasteners extending through the elongated slots 162. A threaded, bolt-like element 170 is secured to the mounting plate 166 and extends outwardly through the housing of the take-up pulley assembly. An adjustment nut 172 disposed on bolt 170 adjustably positions the idler sheave 164.

As best seen in FIG. 12, a plurality of endless drive belts 174 are reaved about the various sheaves or pulleys of the drive assembly. As shown, the belts 174 extend from the idler pulley 164 down and around the main drive pulley 154, then up and over the drive pulley for the right-hand auger assembly 156, then downwardly and around the drive pulley assembly 155 for the left-hand preblending auger assembly. As is readily apparent, therefore, rotation of the output shaft of the main drive motor in the counterclockwise direction when viewed from behind as in FIG. 12 results in clockwise rotation of the right-hand preblending auger assembly and counterclockwise rotation of the left-hand preblending auger assembly. As a result, the sand-/binder additive mixture in each of the preblending tubes will be conveyed from a forward to a rearward direction, or from the left to the right when viewed in FIGS. 5 and 6. The sand/binder additive mixture deposited into the primary mixing tube will, therefore, be driven from the right to the left when viewed in FIG. 5.

In an example of a muller in accordance with the present invention, all three tubes are driven by a 1150 max rpm, AC motor; the premixing tubes have a diameter of approximately 6 inches and a length of approximately 16 inches; and the main mixing tube has a diameter of approximately eight inches and a length of approximately 28 inches. The spiral conveyor section of the premixing tubes has a pitch of approximately one inch and each paddle assembly includes four blades equally spaced on the central hub at 90° intervals and positioned at an angle of approximately 17°. The spiral conveyor section of the primary mixing tube has a pitch of approximately one and one-third inches and the blades of each paddle assembly are positioned and angled the same as with the premixing tubes.

As will be apparent to one familiar with continuous muller arrangements, the dimensions of each auger assembly and the number and length of the spiral sections and paddle sections could be varied to obtain any desired output rate. With the arrangement first described, the muller has a maximum output of approximately 500 pounds per minute and a sand mix residence time of four to five seconds. A primary consideration in determining final dimensions for the present muller is the need to keep the residence time low so that the full benefits from the quick setting binder additives may be obtained and so that the muller will be essentially self-cleaning.

Figure 13:
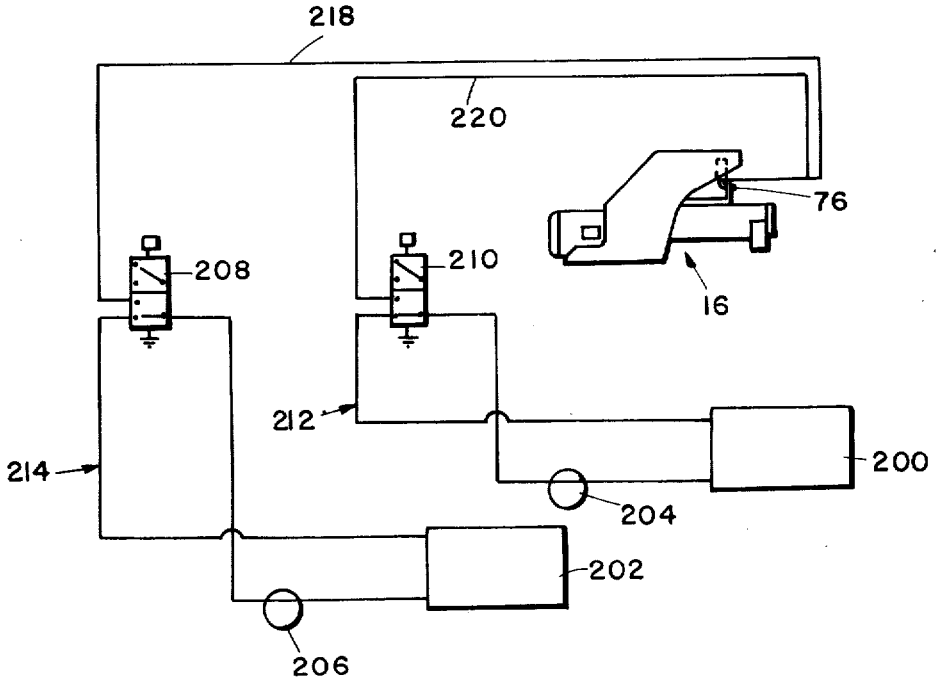
FIG. 13 is a schematic illustration of the binder additive system employed with the present invention.
Figure 11:
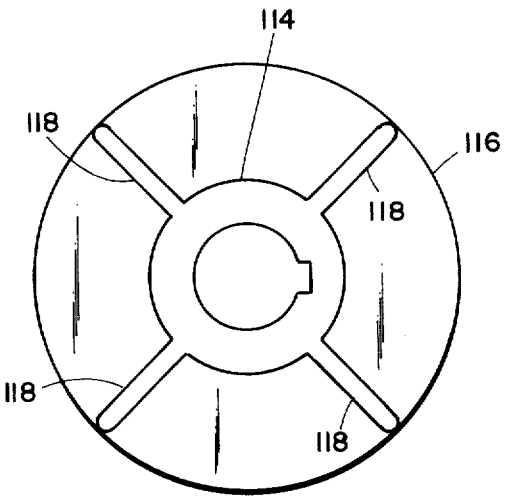
FIG. 11 is a front elevational view of a typical slinger employed in the present invention.
Figure 10:
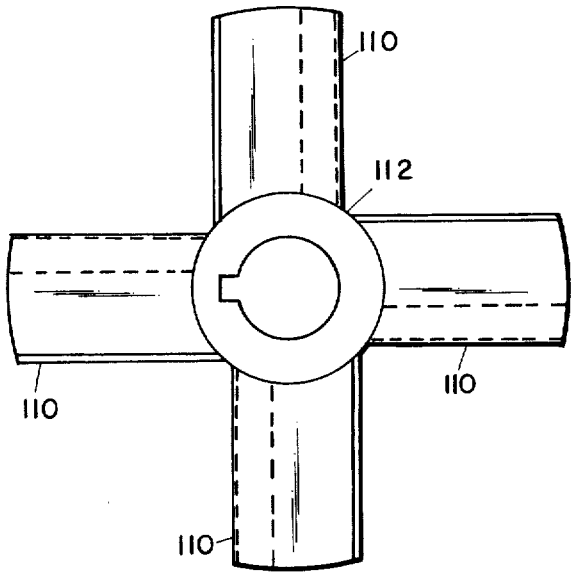
FIG. 10 is a front elevational view of a typical paddle assembly in accordance with the present invention.

With reference to FIG. 13, the unique recirculating binder additive system is illustrated. As shown therein, the system includes a resin supply tank 200, a catalyst supply tank 202, a resin supply pump 204, a catalyst supply pump 206, a pair of solenoid operated, three-way diverter valves 208, 210 and suitable resin supply and recirculating tubing 212 and catalyst supply and recirculating tubing 214.

The solenoid operated diverter valves may be of a conventional type such as manufactured by the R. G. Laurence Company, Inc., Tenafly, N.J. Such diverter valves are of the rotary shaft, normally closed, energized to open variety. The pumps 204, 206 are each preferably driven by a variable speed, DC motor through the use of a potentiometer. The catalyst pump must be one which is suitable for the acidic nature of the catalyst and capable of continuous operation. The resin pump must be capable of continuous operation and be compatible with the various types of resins employed in the available binder systems. Suitable pumps are commercially available.

In operation, the pumps 204, 206 are run continuously upon start-up. The diverter valves 208, 210 are in their normally closed positions so that the binder additives are recirculatd through the pumps and the supply tanks. Upon actuation of the diverter valves 208, 210 by the control system, which will be more fully described below, the binder additives are directed through distribution lines 218, 220 to the premixing tubes 42, 44 respectively. Line 218 is connected to coupling 76 to supply catalyst to tube 42 in a tangential manner. Line 220 is likewise connected to coupling 78 of premixing tube 44. In the alternative, the lines 218, 220 could be directly connected to the tubes at suitable threaded apertures, the important consideration for optimum performance being supply of the binder additives to points downstream of the foundry sand inlets. By employing variable speed, potentiometer controlled DC motor driven pumps, any desired amount of catalyst and resin may be metered into a known quantity of sand which will be deposited into the preblending or premixing tubes by the conveyor assembly 14. Check valves may be placed adjacent the outlets of lines 218, 220 to prevent return flow of the additives.

Figure 14:
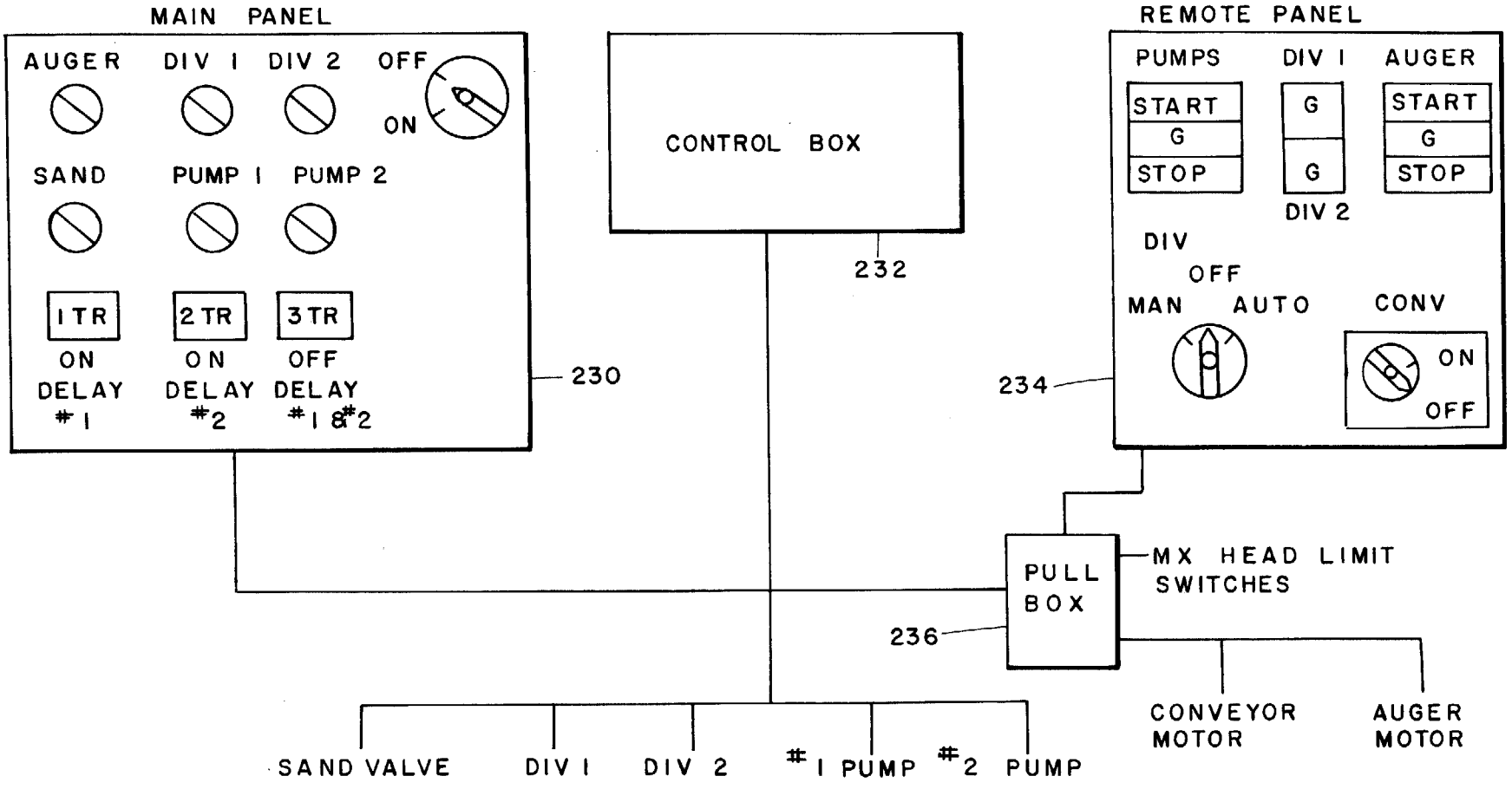
FIG. 14 is a schematic illustration of the control system employed with the present invention.

A simplified schematic of a control system for use with the present invention is illustrated in FIG. 14. As shown therein, the control system includes a main control panel 230, a control box 232 and a remote panel 234. As seen in FIG. 1, the remote panel 234 is mounted on the end of a control arm 236 in front of the mixing head assembly. The main control panel 230 includes a main on/off switch, key interlocks for the auger drive motor, the sand conveyor motors, the diverter valves, and the resin and catalyst pumps. Further, the panel 230 includes indicator lights for the on-delay and off-delay timers for the diverter valves incorporated in the solid-state control system. The remote panel 234 which is mounted for ready operator use includes a pump start and stop switch and indicator light, diverter valve indicator lights an auger start and stop switch and indicator light, and a conveyor on/off toggle switch. The various panels and controls are connected through a pull box 236 to the sand conveyor motor, the main auger drive motor, the sand metering valve, the diverter valves, and the resin and catalyst pumps. The control box 232 includes a pair of timers which delay actuation of the diverter valves upon actuation of the sand feed conveyor motor so that the sand reaches the preblending tubes before the resin and catalyst are injected. Further, a third off-delay timer may be included to delay closing of the diverter valves until after the sand conveyor is stopped. The control box 232 would also include the solid-stage controls for each of the DC motors. All of the electrical/electronic components of the control system are conventional, readily available items.

Once the continuous muller in accordance with the present invention has been installed in the foundry, the various systems must be calibrated prior to operation. First, the main conveyor assembly is actuated and the quantity of sand per unit time delivered is measured. The delivery rate may be adjusted by the variable sand metering valve. Next, the amount of resin and catalyst delivered by the pumps 204, 206 is determined and set by operating the pumps and placing the distribution lines 220, 218 in a container of known volume. The volume per time period is then measured. By varying the potentiometer controls contained in the control box 232, the feed rate of the pumps is varied until the desired amount of resin and catalyst per metered quantity of sand is obtained. In order to perform these manual calibration steps, the control system may include a diverter valve manual operating position. During normal operation, however, the diverter valve switch is placed in the automatic position.

Once the binder additive pumps have been calibrated, the muller is ready for operation. The mixing head is positioned over a core box or mold flask and the conveyor toggle switch on the remote panel is moved to the "on" position. As a result, the sand metering valve is actuated through the main control panel 230 and the conveyor is turned on. After a suitable delay period determined by the timers contained in the control box 232, the diverter valves are actuated and resin and catalyst are directed through the distribution lines to the couplings at each premixing tube. As a result, sand and resin binder are thoroughly mixed and preblended in one tube, while sand and catalyst are thoroughly mixed in the other preblending tube. Both of these premix or preblending tubes then simultaneously deposit thier sand additive mixtures into the primary mixing tube 46. The preblended components are combined and thoroughly mixed in the primary mixing tube. The sand mixture is then compacted or impacted into the core box or mold flask by the slinger on the primary auger. When no more sand mixture is required, the operator merely moves the toggle switch to the "off" position, instantly shutting off the conveyor. The main auger motor may then be permitted to run for an additional four to five seconds to thoroughly clean the machine of sand mixture.

Inasmuch as the retention time in the mixing head is on the order of 4 to 5 seconds, the continuous muller in accordance with the present invention is essentially self-cleaning. The sand catalyst and sand resin binder mixture is not present in the primary auger for a sufficient period of time to present any significant material buildup problems. Due to this short retention period, any problems with precuring prior to deposition in the mold or core box are essentially eliminated.

With prior continuous mullers employing a single trough and having sand retention times on the order of 25 seconds, the only way to thoroughly clean the muller was to introduce raw sand without binder or catalyst. This cleaning procedure wasted approximately 1 minute of mixable sand. No such problems are present with the continuous muller in accordance with the subject invention and, therefore, substantial savings in foundry sand costs result.

The continuous muller provides a lump-free and essentially streak-free mixture. As a result, the full mechanical properties of the foundry sand and resin binder may be obtained. Further, due to the continuous, instant on/off mode of operation of the present muller, increased core and mold production is made available to the foundry operator. The present muller may be used to thoroughly mix and prepare any of the now known resin catalyst binder systems. By adding another additive pump/valve and suitable controls, three level binder systems may also be used. Further, the muller is readily adaptable to air set silicate and sodium silicate molding processes.

It can, therefore, be seen that the continuous muller in accordance with the present invention substantially alleviates the problems heretofore found when employing prior mullers to thoroughly mix foundry sand and relatively fast-setting resin binder system. It is expressly intended that the foregoing description be considered as that of the preferred embodiment. The true spirit and scope of the present invention will be determined by reference to the appended claims.

The embodiments of the invention in which an exclusive property or privilege is claimed are defined as follows.

1. A continuous muller including a sand conveyor and a mixing head rotatably mounted to said sand conveyor for mixing foundry sand and binder additives for core and mold production, said mixing head comprising:

a support frame having a pair of parallel, spaced side plates and a support plate extending transversely between said side plates;

a first and a second preblending means, each of said preblending means including an elongated cylindrical tube secured to said frame and having a sand inlet aperture adjacent the forward end of said tube and a sand outlet adjacent the rear end of said tube, a high-speed, high-intensity premixing auger means rotatably mounted within said tube for blending and continuously conveying a sand and additive mixture from the forward inlet to the rear outlet, and a binder additive inlet intersecting said tube at an angle with respect to the tube longitudinal center line and at a point adjacent to and downstream from said sand inlet aperture, said cylindrical tubes of said preblending assemblies being positioned in the same horizontal plane;

means for securing said preblending tubes to said frame including a heat plate positioned in front of said preblending tubes and a plurality of tie rods extending through said head plate and said support plate;

a primary mixing means positioned below and extending parallel with said first and second preblending means, said primary mixing means including a primary elongated cylindrical tube secured to said frame having an inlet aperture at the rear thereof and positioned below said outlets of said preblending means, an outlet aperture adjacent the forward end thereof, a premix outlet tube connecting said preblending means outlets with said primary tube inlet, and high-speed, high-intensity, primary auger means rotatably mounted within said primary tube for thoroughly combining said preblended mixtures and continuously conveying said combined mixture to said primary tube outlet;

means for securing said primary tube to said frame including a primary head plate positioned in front of said primary tube and a plurality of tie rods extending through said primary head plate and said support plate thereby securing said primary tube to said frame;

a single, high-speed, drive means supported on said frame for rotating said preblending auger means and said primary auger means;

a resin additive supply means connected to one of said binder inlets for supplying a metered quantity of resin; and a catalyst additive supply means connected to the other of said binder inlets for supplying a metered quantity of catalyst.

2. A continuous muller as defined by claim 1 further including control means for actuating said resin additive supply means, said catalyst additive supply means and said single drive means.

3. A continuous muller as defined by claim 2 wherein each of said premixing auger means comprises;

a high-speed shaft rotatably supported at one end by said support plate and at the other end by said head plate.

4. A continuous muller as defined by claim 3 wherein each of said premixing auger means further includes:

a plurality of inlet flightings each having a removable central hub keyed to said high-speed shaft and an outwardly extending thread-like portion, said thread-like portion having a plurality of spaced cutouts adjacent the base thereof to increase the mixing action;

a plurality of separate paddle assemblies downstream of said inlet flightings, each paddle assembly having a removable central hub, keyed to said shaft and a plurality of spaced blades disposed on said hub at an acute angle with respect to the longitudinal center line of said shaft; and an output slinger removably keyed to said shaft downstream of said paddle assemblies for positively propelling the sand mixture to said primary mixing auger means.

5. A continuous muller as defined by claim 4 wherein said high-speed, high-intensity primary auger means rotatably supported within said tube comprises:

a high-speed shaft rotatably supported at one end by said support plate and at the other end by said primary head plate;

a spiral conveyor section secured to said shaft;

a paddle mixing section secured to said shaft downstream of said spiral conveyor section; and an output section having a slinger secured to said shaft downstream of said paddle mixing section for positively propelling the combined mixture through said outlet into a core box or flask mold.

6. A continuous muller as defined by claim 5 wherein said conveyor section of said primary auger means comprises:

a plurality of separate flightings, each of said flightings including a central hub removably keyed to said shaft and an outwardly extending, spiral thread-like portion, said thread-like portion having a plurality of spaced cutouts adjacent the base thereof.

7. A continuous muller as defined by claim 6 wherein said single drive means comprises:

a plurality of drive sheaves, one non-rotatably secured to one end of said high-speed shafts;

an idler sheave adjustable mounted on said support frame;

an endless drive belt reaved around said drive sheaves and said idler sheave; and a high-speed drive motor connected to one of said high-speed shafts.

8. A continuous muller as defined by claim 7 wherein said resin additive supply means and said catalyst additive supply means each comprise:

a supply tank;

a pump having an inlet connected to said supply tank;

a three-way diverter valve having an inlet port connected to the outlet of said pump, an outlet port connected to one of said binder inlets, and an outlet port connected to said supply tank, said pump being a variable discharge pump and said valve being a solenoid operated valve and wherein said control means continuously runs said resin pump and said catalyst pump and further actuates said diverter valves upon delivery of sand to sand preblending means.

* * * * *